US009822771B2

(12) United States Patent
Suita

(10) Patent No.: US 9,822,771 B2
(45) Date of Patent: Nov. 21, 2017

(54) COMPRESSED AIR DRIVEN RECIPROCATING PISTON HYDRAULIC PUMP

(71) Applicant: PASCAL ENGINEERING CORPORATION, Hyogo (JP)

(72) Inventor: Motoki Suita, Hyogo (JP)

(73) Assignee: Pascal Engineering Corporation, Hyogo (JP)

( * ) Notice: Subject to any disclaimer, the term of this patent is extended or adjusted under 35 U.S.C. 154(b) by 333 days.

(21) Appl. No.: 14/423,514

(22) PCT Filed: Jul. 5, 2013

(86) PCT No.: PCT/JP2013/068510
§ 371 (c)(1),
(2) Date: Feb. 24, 2015

(87) PCT Pub. No.: WO2014/034270
PCT Pub. Date: Mar. 6, 2014

(65) Prior Publication Data

US 2016/0201656 A1 Jul. 14, 2016

(30) Foreign Application Priority Data

Aug. 28, 2012 (JP) ..... 2012-187139

(51) Int. Cl.
*F04B 17/00* (2006.01)
*F04B 9/127* (2006.01)
(Continued)

(52) U.S. Cl.
CPC ..... *F04B 9/127* (2013.01); *F04B 53/10* (2013.01); *F04B 53/121* (2013.01); *F04B 53/14* (2013.01); *F04B 53/16* (2013.01)

(58) Field of Classification Search
CPC ..... F04B 9/127; F04B 53/14; F04B 53/16; F04B 53/10; F04B 53/121
See application file for complete search history.

(56) References Cited

U.S. PATENT DOCUMENTS 3,272,081 A * 9/1966 Vedder ..... F01B 17/00 91/228
4,042,311 A * 8/1977 Yonezawa ..... F04B 9/127 417/401

(Continued)

FOREIGN PATENT DOCUMENTS

| | | |
|---|---|---|
| JP | 61-277801 | 12/1986 |
| JP | 3-229004 | 10/1991 |
| JP | 2005-201164 | 7/2005 |

OTHER PUBLICATIONS

Microfilm of hte specification and drawings annexed to the request of Japanese Utility Model Application No. 39366/1989 (Laid-open No. 130401/1990) JP 2-130401 (Aioi Seiki Inc.), Oct. 26, 1990 (Oct. 26, 1990), fig. 3 (Family: none).
International Search Report of PCT/EP2013/068510.

*Primary Examiner* — Charles Freay
(74) *Attorney, Agent, or Firm* — Norris, McLaughlin & Marcus, P.A.

(57) ABSTRACT

An air driven reciprocating piston hydraulic pump having a main changeover valve with a main valve body having an annular valve body portion which includes first and second annular valve faces that approach closely or contact first and second annular valve seats on valve cases which are formed on the upper and the lower ends of the annular valve body portion. An air intake chamber is defined by a piston reception hole and a drive piston portion, and an auxiliary changeover valve changes over the main changeover valve between its air supply position and its air discharge position by supplying compressed air to the air intake chamber or (Continued)

discharging air therefrom via a first and second valve members and a small diameter portion of a valve rod. A center side portion of the main valve body is made as a separate auxiliary valve body for facilitating up and down motion thereof.

7 Claims, 6 Drawing Sheets

(51) Int. Cl.

| | |
|---|---|
| ***F04B 53/10*** | (2006.01) |
| ***F04B 53/14*** | (2006.01) |
| ***F04B 53/16*** | (2006.01) |
| ***F04B 53/12*** | (2006.01) |

(56) References Cited

U.S. PATENT DOCUMENTS 4,110,983 A * 9/1978 Sherman ..... B62D 33/07
180/89.18
4,812,109 A * 3/1989 Yonezawa ..... F04B 9/107
417/401
4,993,924 A * 2/1991 Mukumoto ..... F01L 25/063
137/512.3
5,050,482 A 9/1991 Yonezawa et al.
5,252,042 A * 10/1993 Yonezawa ..... F01B 11/02
417/401

* cited by examiner

COMPRESSED AIR DRIVEN RECIPROCATING PISTON HYDRAULIC PUMP

TECHNICAL FIELD

The present invention relates to a compressed air driven reciprocating piston hydraulic pump, and in particular relates to such a pump that has been improved so that its valve body does not go into a neutral position (i.e. into a state in which all of its ports are open).

BACKGROUND OF THE INVENTION

From the past, a compressed air driven reciprocating piston hydraulic pump having a basic construction as described below has been widely applied. As this basic construction, a reciprocating piston hydraulic pump of this type described in Patent Document #1 comprises: a piston installed in a cylinder hole of a cylinder member and reciprocatingly driven to and fro along the axial direction thereof; a forward motion chamber and a return motion chamber at opposite ends of the piston in the cylinder hole, a compression spring for return motion provided in the return motion chamber, a hydraulic pump mechanism including a plunger extending from a center portion of the piston toward the return motion chamber, a valve case having a partition wall portion that serves as an end wall of the forward motion chamber and fixed to an end portion of the cylinder member, an air supply opening for supply of compressed air and an air discharge outlet provided in the valve case, and a changeover valve mechanism including a main changeover valve that operates to change over repeatedly between an air supply position in which it communicates the forward motion chamber with the air supply opening and an air discharge position in which it communicates the forward motion chamber with the air discharge outlet, and an auxiliary changeover valve that operates in synchrony together with the main changeover valve and that changes over the position of the main changeover valve.

The main changeover valve comprises a main valve body having an annular valve body portion that is biased toward an air supply position by compressed air in an annular air passage that is communicated to the air supply opening and a piston portion defining portion that is formed integrally with the annular valve body portion, and that is shiftable along the axial direction. And the annular valve body portion has first and second annular valve faces that are formed at its two ends in its shifting direction and that alternatively contact against first and second annular valve seats of the valve case, while the piston portion defining portion comprises a piston portion that is received in a cylindrical hole formed in the valve case.

The auxiliary changeover valve changes over the main changeover valve to its air supply position when forward motion of the piston starts by discharging compressed air from the air intake chamber defined by the cylindrical hole and the piston portion, and also changes over the main changeover valve to its air discharge position when return motion starts by intaking compressed air to the air intake chamber. Due to the piston repeatedly performing reciprocating motion in this manner, the hydraulic pump mechanism generates hydraulic pressure.

For the hydraulic pump of Patent Document #1, a construction of the following type is employed in order to solve the problem that, when the pressure of the compressed air supplied to the air supply opening drops to a set pressure or below, the biasing force that biases the annular valve body portion toward its air supply position with the compressed air in the annular air passage diminishes, so that the main changeover valve may go into a neutral position (i.e. into an all ports open state). That is to say, in this construction, a first valve seat which is separated from the first valve face during the air supply position is formed on a movable member that is movable with respect to the valve case, and the movable member is biased by a compression spring toward its valve closed side in which the first valve seat contacts against the first valve face, while, when the pressure of the supply of compressed air has become at least a pressure corresponding to the valve closing force of the compression spring, the first valve face and the first valve seat are separated.

And the compressed air driven reciprocating piston hydraulic pump of Patent Document #2 has a basic construction similar to the basic construction described above. In this hydraulic pump, the main changeover valve comprises an annular valve body portion that is biased toward an air supply position by compressed air in an annular air passage that is communicated to an air supply opening and a cylindrical hole defining portion that is formed integrally with the annular valve body portion, and an air intake chamber, is formed by inserting a piston portion into a cylindrical hole of the cylindrical hole defining portion, with an exhaust valve being provided that opens and closes an air discharge outlet of the air intake chamber. A valve rod of an auxiliary changeover valve is operatively linked to the piston and is inserted into an internal hole that is communicated to the air intake chamber, and an intake valve is provided, in which an O ring is fitted in an annular groove at a portion neighboring the upper end of the valve rod.

When the piston has arrived at its return motion limiting position, the exhaust valve is opened by the end of the valve rod and the compressed air in the air intake chamber is discharged, and, by the main changeover valve being changed over to its air supply position by the pressure of the compressed air that operates on the main changeover valve, compressed air is supplied to the forward motion chamber and the piston is made to move forward. Thereafter, when the piston has reached its forward limiting position, the intake valve is opened and compressed air is intaken into the air intake chamber, so that the piston is caused to perform return motion due to the main changeover valve being changed over to its air discharge position. The hydraulic pump mechanism generates hydraulic pressure by the piston being made to perform repeated reciprocating action in this manner.

With this hydraulic pump, the following construction is employed in order to solve the problem that, if a hydraulic leak or the like should occur in the destination for supply of hydraulic fluid, then, when the piston executes forward motion at an extremely low speed, the main changeover valve may go into a neutral position (i.e. into a state in which all the ports are open). In order to solve such a problem, the following structure is applied.

In this construction, it is arranged for the valve rod to be movably linked to the piston and for air pressure in the forward motion chamber to act on an annular pressure reception portion of the valve rod at the boundary between a large diameter portion and a small diameter portion thereof in the direction to close the valve, and, directly before the piston reaches its forward motion limiting position, due to compressed air at low pressure that has gradually flowed from the intake valve into an internal hole, the valve rod is made to perform valve opening operation all of a sudden against the resistance of the valve closing force of the compressed air which is acting on the annular pressure reception portion, so that the intake valve goes into the fully opened state, and the main changeover valve is changed over to its air discharge position.

Patent Document #1: JP Laid-Open Patent Publication S61-277801.

Patent Document #2: JP Laid-Open Patent Publication 2005-201164.

SUMMARY OF THE INVENTION

With the hydraulic pump of Patent Document #1, it is not possible to solve the problem of there being a possibility that, when the piston performs forward motion at extremely low speed, the main changeover valve may go to a neutral position (i.e. a state in which all the ports are open), as with the problem of Patent Document #2.

Moreover, with the hydraulic pump of Patent Document #2, since the valve closing force of the compressed air that operates on the annular pressure reception portion of the valve rod depends on the pressure of the compressed air supplied from the compressed air source, accordingly there are the problems that it is difficult to stabilize the timing at which the intake valve becomes fully open because the valve closing force fluctuates according to the pressure of the compressed air, that the valve rod and the piston generate a clattering noise because the valve rod shifts relatively with respect to the piston, that a clattering noise is generated when the exhaust valve opens and closes because its valve body collides with the valve seat, and so on.

The objects of the present invention are: to provide a compressed air driven reciprocating piston hydraulic pump having an auxiliary changeover valve that operates reliably without experiencing any influence from fluctuations of the pressure of compressed air supplied from a compressed air source; to provide a compressed air driven reciprocating piston hydraulic pump that operates silently with little generation of clattering noise; and so on.

The present invention presents a compressed air driven reciprocating piston hydraulic pump comprising a piston installed in a cylinder hole of a cylinder member and reciprocatingly driven to and fro along an axial direction thereof, a forward motion chamber and a return motion chamber at opposite sides of the piston in the cylinder hole, a compression spring for return motion provided in the return motion chamber, a hydraulic pump mechanism including a plunger extending from a center portion of the piston toward the return motion chamber, a valve case having a partition wall portion that serves as an end wall of the forward motion chamber and fixed to an end portion of the cylinder member, an air supply opening for supply of compressed air and an air discharge outlet provided in the valve case, and a changeover valve mechanism including a main changeover valve that operates to change over repeatedly between an air supply position in which the forward motion chamber is communicated with the air supply opening and an air discharge position in which the forward motion chamber is communicated with the air discharge outlet and an auxiliary changeover valve that operates in synchrony together with the main changeover valve and changes over the position of the main changeover valve, wherein:

the main changeover valve comprises a main valve body that has an annular valve body portion that is biased toward the air supply position by compressed air in an annular air passage communicated to the air supply opening and a piston portion defining portion that is formed integrally with the annular valve body portion, and is shiftable along the axial direction; the annular valve body portion has first and second annular valve faces that are formed at its two ends in its shifting direction and that alternatively contact against first and second annular valve seats of the valve case, and the piston portion defining portion comprises a piston portion that is received in a piston reception hole formed in the valve case; and the auxiliary changeover valve comprises an air intake chamber defined by the piston reception hole and the piston portion, a valve rod that passes through and slides freely in the partition wall portion of the valve case extending from a center portion of the piston towards the forward motion chamber, the air intake chamber, and the valve main body, a small diameter portion formed on the valve rod, a first valve member that is capable of sealing between the valve rod and the main valve body, and a second valve member that is capable of sealing between the valve rod and the partition wall portion;

and built so that the auxiliary changeover valve, along with changing over the main changeover valve to its air supply position when forward motion of the piston starts by releasing a seal of the first valve member by the small diameter portion and discharging compressed air from the air intake chamber, also changes over the main changeover valve to its air discharge position when return motion of the piston starts by releasing a seal of the second valve member by the small diameter portion and intaking compressed air to the air intake chamber;

characterized in that:

a center side portion of the main valve body close to an external circumference of the valve rod is built as an auxiliary valve body that is separate from the other portions than the center side portion;

the auxiliary valve body comprises an auxiliary piston portion that is installed into an auxiliary piston reception hole formed in the piston portion so as to slide freely therein in an airtight manner and that faces into the air intake chamber, and a tubular portion that extends from the auxiliary piston portion toward an opposite side to the air intake chamber and that is installed in a cylindrical hole of the main valve body so as to slide freely therein; and along with an end portion of the tubular portion of the auxiliary valve body being faced into the air discharge outlet, a compression spring is provided that biases the auxiliary valve body toward the air intake chamber, and the first valve member is installed in the tubular portion.

The present invention may have the following configuration.

As $1^{st}$ example, preferably, a barrel portion is provided, formed integrally with the annular valve body portion and extending from an opposite side to the piston reception hole, and fitted into a cylinder hole of the valve case so as to slide freely therein, and in that the annular air passage is formed on an external circumference of the barrel portion.

As $2^{nd}$ example, preferably, an annular air exhaust passage is defined by the annular valve body portion of the main valve body, the piston portion defining portion, and the valve case, and an air passage that communicates the annular air exhaust passage to the air discharge outlet is formed in the main valve body.

As $3^{rd}$ example, preferably, an air passage for intaking compressed air from the air supply opening to the air intake chamber is formed in the valve case, and an air passage capable of discharging compressed air from the air intake chamber is defined between the tubular portion of the auxiliary valve body and an outer circumferential surface of the valve rod.

As $4^{th}$ example, preferably, the second valve member is installed in an annular clearance between the valve rod and the partition wall portion so as to be movable in a length direction of the valve rod, and a small diameter barrel portion that receives and stops the second valve member from the air intake chamber side is provided extending from the auxiliary piston portion of the auxiliary valve body and inserted into the annular clearance.

As $5^{th}$ example, preferably, the structure is such that, when the piston has reached its forward motion limiting position, the auxiliary valve body is relatively shifted with respect to the main valve body by compressed air intaken into the air intake chamber from between an end portion of the small diameter portion of the valve rod and the second valve member, so that the sealing of the second valve member is released.

As $6^{th}$ example, preferably, a compression spring is provided that biases the main valve body of the main changeover valve to the air supply position.

According to the present invention, when the piston reaches its forward motion limiting position and return motion starts, when the sealing of the second valve member starts to be released via the small diameter portion of the valve rod, compressed air flowing into the air intake chamber little by little operates on the auxiliary piston portion of the auxiliary valve body. Since the auxiliary valve body has the auxiliary piston portion and the tubular portion, and this tubular portion is faced into the air discharge outlet, accordingly the auxiliary valve body shifts in the direction to eliminate the sealing of the second valve member due to the pressure of the small amount of compressed air that has flowed into the air intake chamber, and the main changeover valve is reliably changed over to its air discharge position, since the sealing of the second valve member is instantaneously and reliably released so that compressed air is intaken into the air intake chamber. Due to this, the main changeover valve does not go into an all ports opened state.

Even if the pressure of the compressed air intaken into the air intake chamber fluctuates, still the auxiliary valve body of the hydraulic pump does not experience any influence from the fluctuation, so that, due to operation like that described above, no influence is experienced due to fluctuations of the supply air pressure.

Moreover, with this hydraulic pump, since a construction is employed in which the valve rod does not collide with any metallic member, accordingly no clattering noise is generated from the surroundings of the valve rod, so that the durability is excellent According to the $1^{st}$ example, the annular air passage is formed on the external circumference of the barrel portion of the main valve body, so that it is possible to bias the annular valve body portion towards its air supply position by the pressure of air therein.

According to the $2^{nd}$ example, it is possible rapidly to discharge compressed air from the annular air discharge passage via the air passage that is formed in the valve main body.

According to the $3^{rd}$ example, compressed air can be intaken via the air passage formed in the valve case to the air intake chamber, and moreover compressed air in the air intake chamber can be discharged from the air passage between the tubular portion of the auxiliary valve body and the outer circumferential surface of the valve rod.

According to the $4^{th}$ example, until the piston reaches its forward motion limiting position, the second valve member is pressed from the air intake chamber side by the small diameter barrel portion of the auxiliary valve body, and thereafter, together with the operation of shifting of the small diameter barrel portion toward the air intake chamber side, it is possible for the second valve member to be shifted toward the air intake chamber side.

According to the $5^{th}$ example, when the piston has reached its forward motion limiting position, it is possible to release the sealing of the second valve member by making the auxiliary valve body shift relatively with respect to the main valve body due to the compressed air that is intaken into the air intake chamber from between the end portion of the small diameter portion of the valve rod and the second valve member.

According to the $6^{th}$ example, since the compression spring that biases the main valve body of the main changeover valve to its air supply position is provided, accordingly it becomes difficult for the main valve body of the main changeover valve to remain in a neutral position (i.e. an intermediate position between its air supply position and its air discharge position).

DESCRIPTION OF THE PREFERRED EMBODIMENTS

The present invention will now be explained on the basis of an embodiment thereof.

The compressed air driven reciprocating piston hydraulic pump P according to this embodiment is a pump that generates hydraulic pressure by means of compressed air. Moreover, in this specification, "hydraulic pressure" means hydraulic fluid under pressure.

Figure 1:
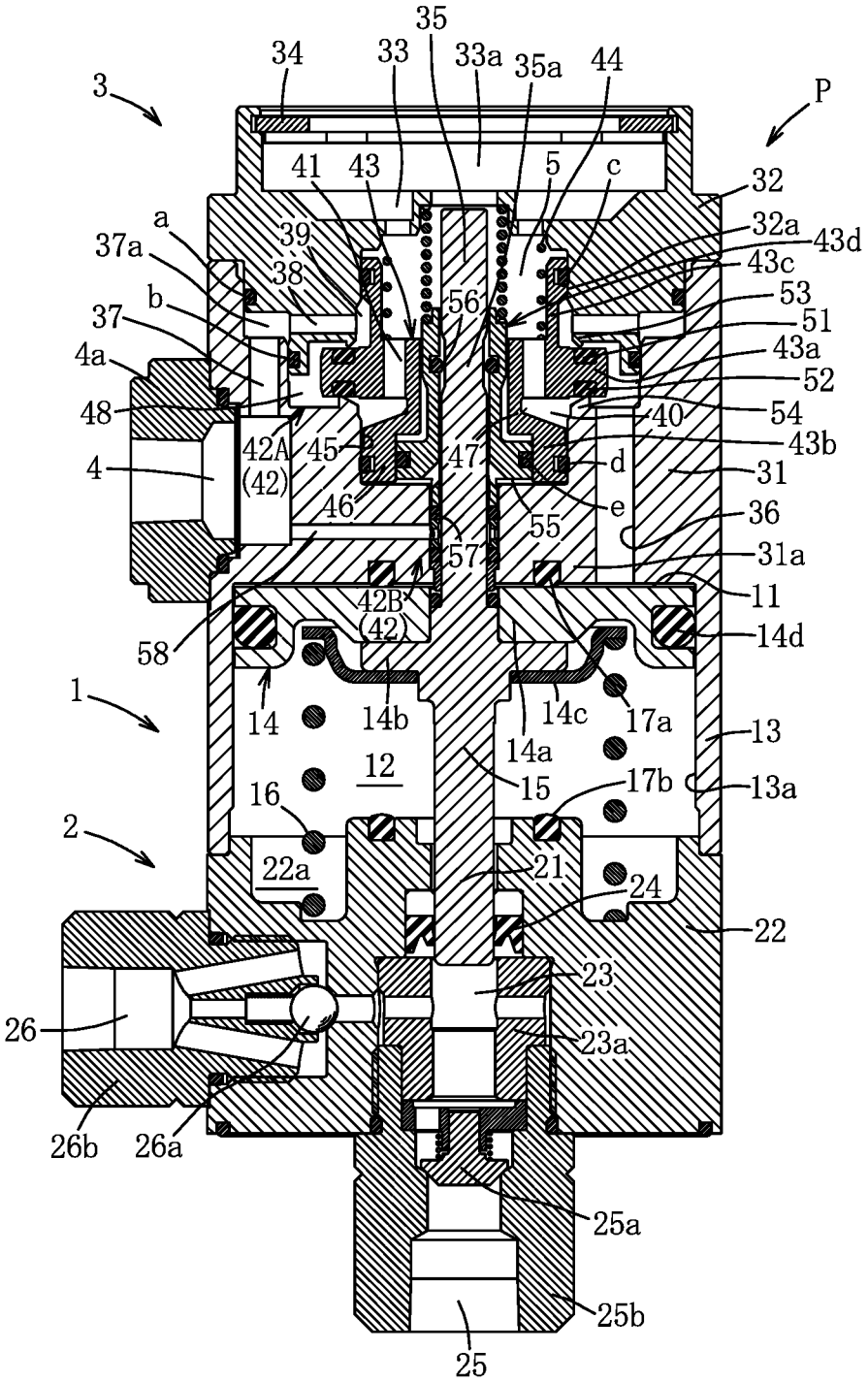
FIG. 1 is a vertical sectional view of a compressed air driven reciprocating piston hydraulic pump (with a piston thereof in its return motion limiting position) according to an embodiment of the present invention.
Figure 2:
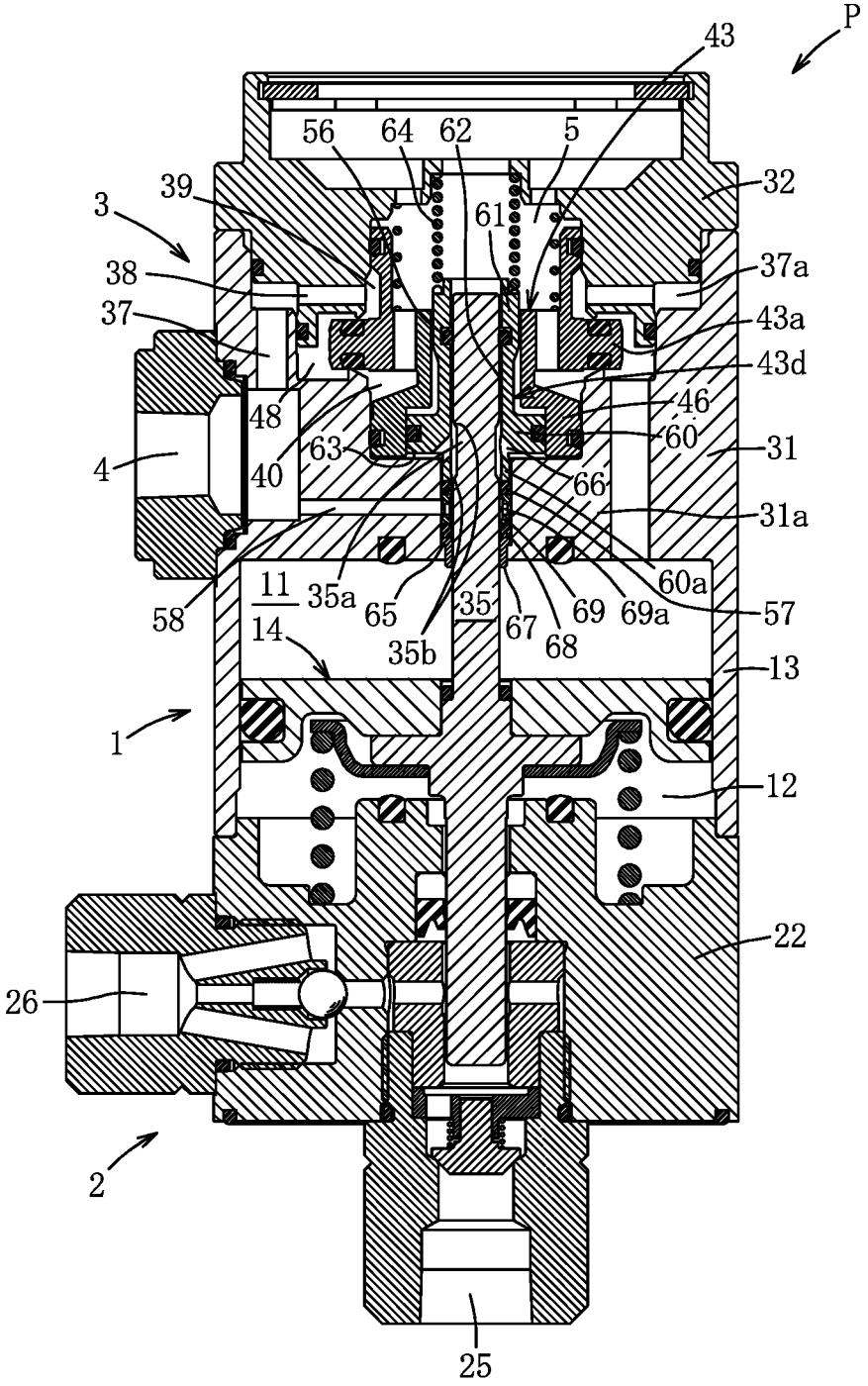
FIG. 2 is a vertical sectional view of the hydraulic pump (directly after its piston has reached its forward motion limiting position)

As shown in FIG. 1 and FIG. 2, this hydraulic pump P comprises a single acting type air cylinder 1, a changeover valve mechanism section 3 that changes over between supply of compressed air to a forward motion chamber 11 of this air cylinder 1 and discharge of air therefrom, a hydraulic pump mechanism section 2 that is driven by the air cylinder 1 and that includes a plunger 21, an air supply opening 4 to which compressed air is supplied from an external compressed air source, a discharge outlet 5 that discharges compressed air to the exterior, and so on.

The air supply opening 4 is formed in a port fitting **4*a* that is fitted in a valve case 31 and in the valve case 31, and an air hose or an air conduit that supplies compressed air is coupled to this port fitting 4*a*. The air discharge outlet 5 is formed in the central portion of an upper end valve case 32 of the changeover valve mechanism section 3, and this air discharge outlet 5 is communicated with a noise muffling chamber 33 that contains a silencer 33***a*, with this noise muffling chamber 33 being opened to atmosphere. Incidentally, the silencer 33*a* is retained in place by a retaining ring 34.

The air cylinder 1 comprises a cylinder member 13, a piston 14 that is installed in a cylinder hole 13*a* of the cylinder member 13 and that is repeatedly driven to and fro along the direction of the axis of the cylinder hole 13*a*, a piston rod 15, a forward motion chamber 11 and a return motion chamber 12 that are defined within the cylinder hole 13*a* on the two sides of the piston 14, a compression spring 16 that is installed in the return motion chamber 12 and that impels the piston 14 to perform return motion, shock absorption members 17*a*, 17*b* made from a synthetic resin material, and so on. Moreover, the forward motion chamber 11 is defined above the piston 14, while the return motion chamber 12 is defined below the piston 14.

A valve case 31 is formed integrally at the upper end of the cylinder member 13, and the upper end of the forward motion chamber 11 is delimited by a partition wall 31*a* of the valve case 31 (this corresponds to an end wall of the forward motion chamber 11). The lower end of the cylinder member 13 is blocked by a pump case 22, and the pump case 22 is fixed to the cylinder member 13, for example by a plurality of bolts (not shown in the figure).

The piston 14 comprises a piston main body 14*a*, an auxiliary piston 14*b* that contacts against the lower surface of the piston main body 14*a*, and a spring reception member 14*c*. The piston rod 15 extends downward from the center portion of the auxiliary piston 14*b* and passes through the spring reception member 14*c*, while a valve rod 35 (this belongs to the changeover valve mechanism section 3) extends upward from the center portion of the auxiliary piston 14*b* and passes through the piston main body 14*a* and the valve case 31. The external circumferential portion of the piston main body 14*a* is sealed with an O ring 14*d* that is made from a synthetic resin material.

An annular concave portion 22*a* that receives the lower end portion of the compression spring 16 is formed at the upper end of the pump case 22, and the upper end of the compression spring 16 is received by the spring reception member 14*c*, while the lower end of the compression spring 16 is received by the wall surface of the annular concave portion 22*a*. The return motion chamber 12 is vented to atmosphere via a hole not shown in the figure. And a plurality of air passages 36 are formed in the valve case 31 for supplying compressed air to the forward motion chamber 11 and discharging air therefrom.

The hydraulic pump mechanism section 2 comprises the pump case 22, a plunger 21 that is formed integrally at the lower end portion of the piston rod 15, a plunger hole 23 within which this plunger 21 ascends and descends, a seal member 24, an intake port 25 that admits hydraulic fluid and a non return intake valve 25*a*, a discharge port 26 that discharges hydraulic fluid and a non return discharge valve 26*a*, and so on. The plunger hole 23 is formed in a plunger hole member 23*a*. A port fitting 25*b* that defines the intake port 25 and a port fitting 26*b* that defines the discharge port 26 are both fitted to the pump case 22 by being screwed thereinto, and hydraulic hoses or hydraulic conduits are connected to the port fittings 25*b*, 26*b*.

The changeover valve mechanism section 3 comprises: the valve case 31 and the upper end valve case 32; an annular air passage 39 that communicates to the air supply opening 4 via air passages 37, 38; an annular air exhaust passage 40 that communicates to the air discharge outlet 5 via air passages 41; and a changeover valve mechanism 42 that includes a main changeover valve 42A that operates repeatedly to change over between an air supply position (refer to FIG. 3 and FIG. 4) in which it communicates the forward motion chamber 11 to the air supply opening 4 and an air discharge position (refer to FIG. 5 and FIG. 6) in which it communicates the forward motion chamber 11 to the air discharge outlet 5, and an auxiliary changeover valve 42B that works together in synchrony with the main changeover valve 42A to change over the position of a main valve body 43 of the main changeover valve 42A.

As shown in FIGS. 1 through 6, the main changeover valve 42A comprises the main valve body 43 having an annular valve body portion 43*a* that is biased towards an air supply position by compressed air in an annular air passage 39, a piston defining portion 43*b*, and a barrel portion 43*c*. This main valve body 43 is shiftable through, for example, 300 μm to 500 μm along the axial direction of the cylinder hole 13*a* (i.e. in the vertical direction), and is biased downwards by a weak compression spring 44 (i.e. towards its air supply position). The annular valve body portion 43*a* and the piston portion defining portion 43*b* are formed integrally with one another. The piston portion defining portion 43*b* comprises a piston portion 46 that is received in a piston reception hole 45 formed in the valve case 31 so as to slide freely in an airtight manner, and a link barrel portion 47 that extends upward from the piston portion 46 and connects to the annular valve body portion 43*a*.

The barrel portion 43*c* is formed integrally with a portion of the annular valve body portion 43*a* that is intermediate in the radial direction and extends in the direction opposite to the piston reception hole 45 (i.e. upwards), and moreover is fitted into a cylinder hole 32*a* of the upper end valve case 32 so as to slide freely therein. An annular air passage 39 is defined by the annular valve body portion 43*a*, the barrel portion 43*c*, and the upper end valve case 32 around the external circumference of the barrel portion 43*c*. This annular air passage 39 is communicated with the air supply opening 4 by a plurality of radially extending air passages 38 and a single vertically oriented air passage 37. And an annular air passage 48 that communicates with the forward motion chamber 11 via an air passage 36 is defined at the outside of the outer circumferential surface of the annular valve body portion 43*a*.

The annular air exhaust passage 40 is constituted by the annular valve body portion 43*a*, the piston portion defining portion 43*b*, and the valve case 31, and the plurality of air passages 41 are formed in the annular valve body portion 43*a* and communicate the annular air passage 40 with the air discharge outlet 5. The annular valve body portion 43*a* is provided with first and second annular valve faces 51, 52 that are formed at its two ends in the shifting direction (i.e. at its upper and lower ends). The first annular valve face 51 is radially outward of the barrel portion 43*c*, and is constituted by an annular seal member made of synthetic resin that is fitted into an annular groove on the upper end portion of the annular valve body portion 43*a*. And the second annular valve face 52 is below the first annular valve face 51, and is constituted by an annular seal member made of synthetic resin that is fitted into an annular groove on the lower end portion of the annular valve body portion 43*a*.

A first annular valve seat 53 is formed on the upper end valve case 32 and closely approaches to or contacts against the first annular valve face 51, and a second annular valve seat 54 is formed on the valve case 31 and closely approaches to or contacts against the second annular valve face 52; and the structure is adapted so that the first and second annular valve faces 51, 52 contact alternatively against the first and second annular valve seats 53, 54. The state in which the first annular valve face 51 is separated from the first annular valve seat 53 and moreover the second annular valve face 52 is contacted against the second annular valve seat 54 is termed the "air supply position". And, when the main changeover valve 42A is in the air supply position, compressed air provided from the air supply opening 4 is supplied to the forward motion chamber 11 via the air passage 37, the annular air passage 37*a*, the air passage 38, the annular air passages 39 and 48, and the air passage 36.

Conversely to the above, the state in which the second annular valve face 52 is separated from the second annular valve seat 54 and moreover the first annular valve face 51 is contacted against the first annular valve seat 53 is termed the "air discharge position". And, when the main changeover valve 42A is in the air discharge position, compressed air in the forward motion chamber 11 is discharged to the air discharge outlet 5 via the air passage 36, the annular air passage 48, the annular air exhaust passage 40, and the air passage 41.

The auxiliary changeover valve 42B comprises an air intake chamber 55 that is defined by the piston reception hole 45 and the piston portion 46, the valve rod 35, a small diameter portion 35*a* that is formed on the valve rod 35, a first valve member 56 that is capable of sealing between the valve rod 35 and the main valve body 43, and a second valve member 57 that is capable of sealing between the valve rod 35 and the partition wall portion 31*a*. The valve rod 35 extends from the center portion of the auxiliary piston 14*b* toward the forward motion chamber 11, and passes through the partition wall portion 31*a* of the valve case 31, the air intake chamber 55, and the main body 43 so as to slide freely therein. An air passage 58 is formed in the partition wall portion 31*a* for intaking compressed air from the air supply opening 4 to the air intake chamber 55.

A small diameter portion 35*a* of the valve rod 35 is formed as an annular groove of a predetermined length in the vertical direction (for example 6 to 10 mm), and the upper end portion and the lower end portion of the small diameter portion 35*a* are formed as tapered portions 35*b* that gradually decrease in diameter.

As shown in FIG. 1, when the piston 14 is in its upper limit position (i.e. its return motion limiting position), the first valve member 56 is at a position corresponding to an intermediate position in the vertical direction of the small diameter portion 35*a* of the valve rod 35. By contrast, as shown in FIG. 2, when the piston 14 is in its lower limit position (i.e. its forward motion limiting position), the second valve member 57 is at a position corresponding to the tapered portion 35*b* at the lower end of the small diameter portion 35*a* of the valve rod 35

The auxiliary changeover valve 42B is constructed so that, when forward motion of the piston 14 starts, the main valve body 43 is changed over to the air supply position by releasing the sealing of the first valve member 56 by the small diameter portion 35*a* so that compressed air in the air intake chamber 55 is discharged, and also is constructed so that, when return motion of the piston 14 starts, the main valve body 43 is changed over to the air discharge position by releasing the sealing of the second valve member 57 by the small diameter portion 35*a* of the valve rod 35 so that compressed air is intaken into the air intake chamber 55. Incidentally, a plurality of seal members a through e are provided.

Next, the characteristic structure and operation of the present application will be explained.

Figure 3:
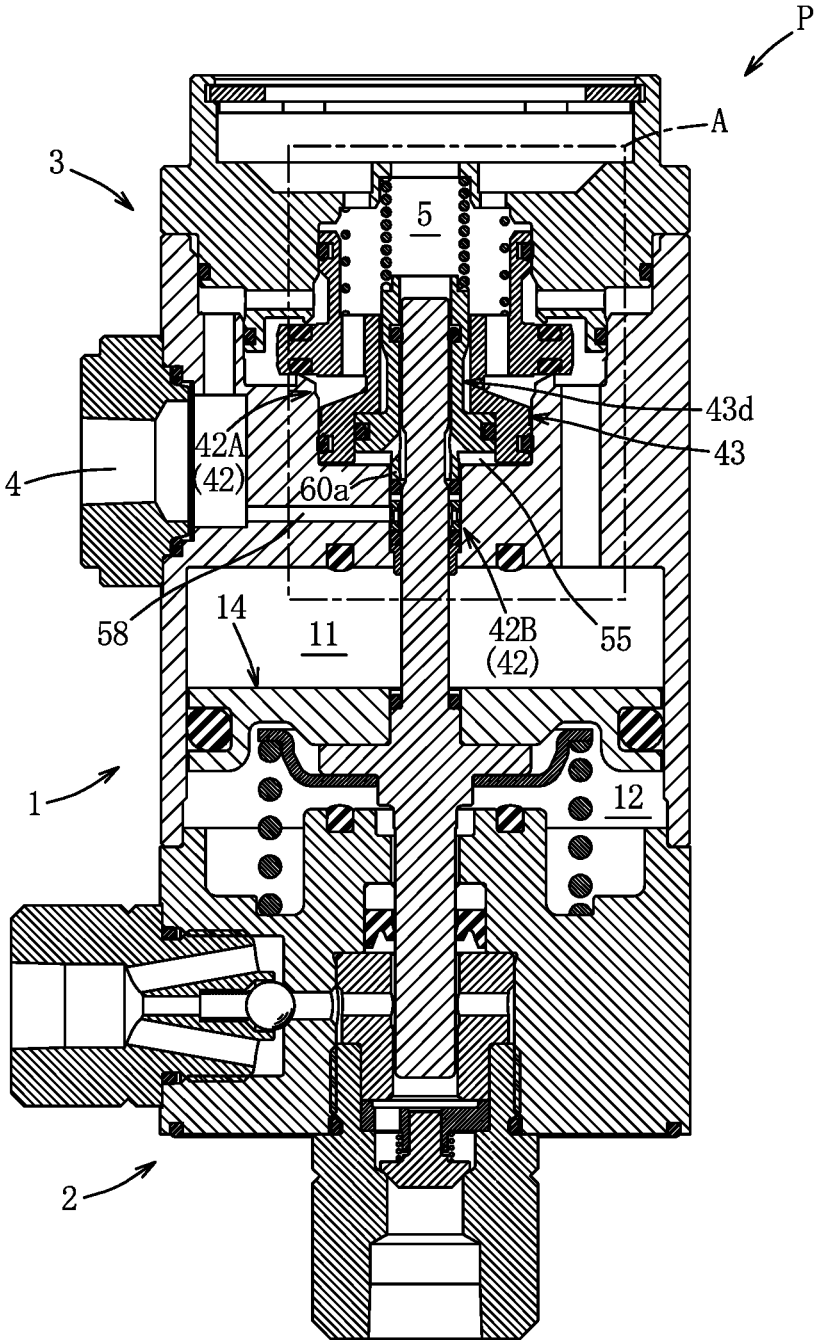
FIG. 3 is a vertical sectional view of the hydraulic pump (directly before its piston starts return motion)
Figure 4:
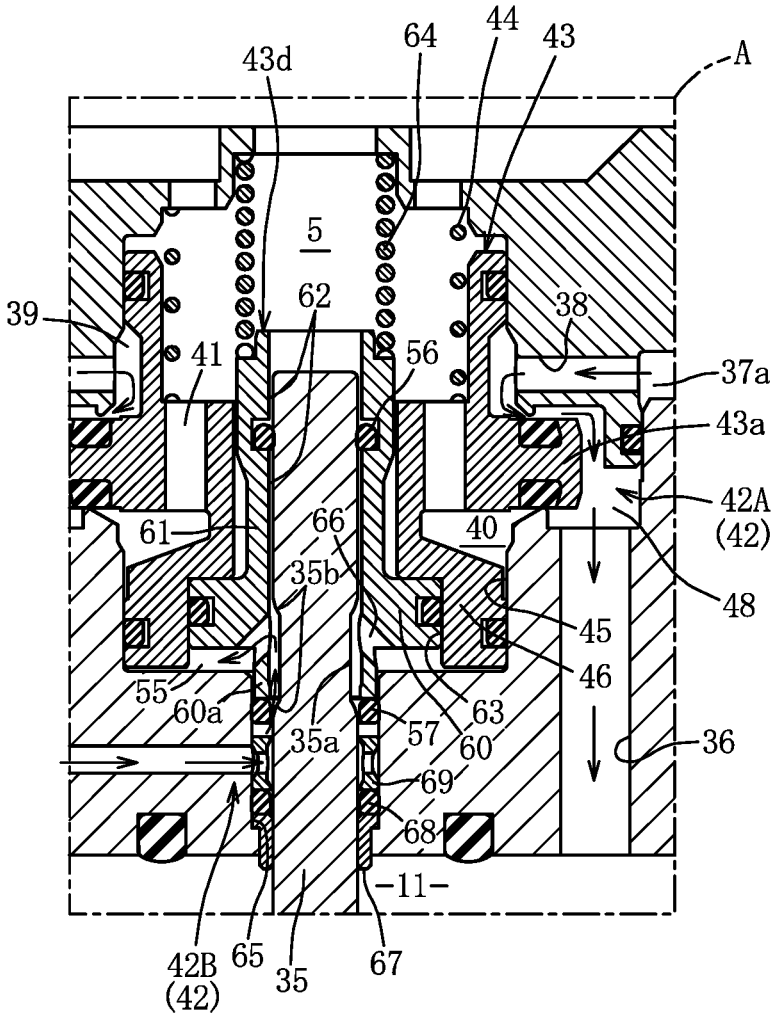
FIG. 4 is an enlarged view of a portion A of FIG. 3.
Figure 5:
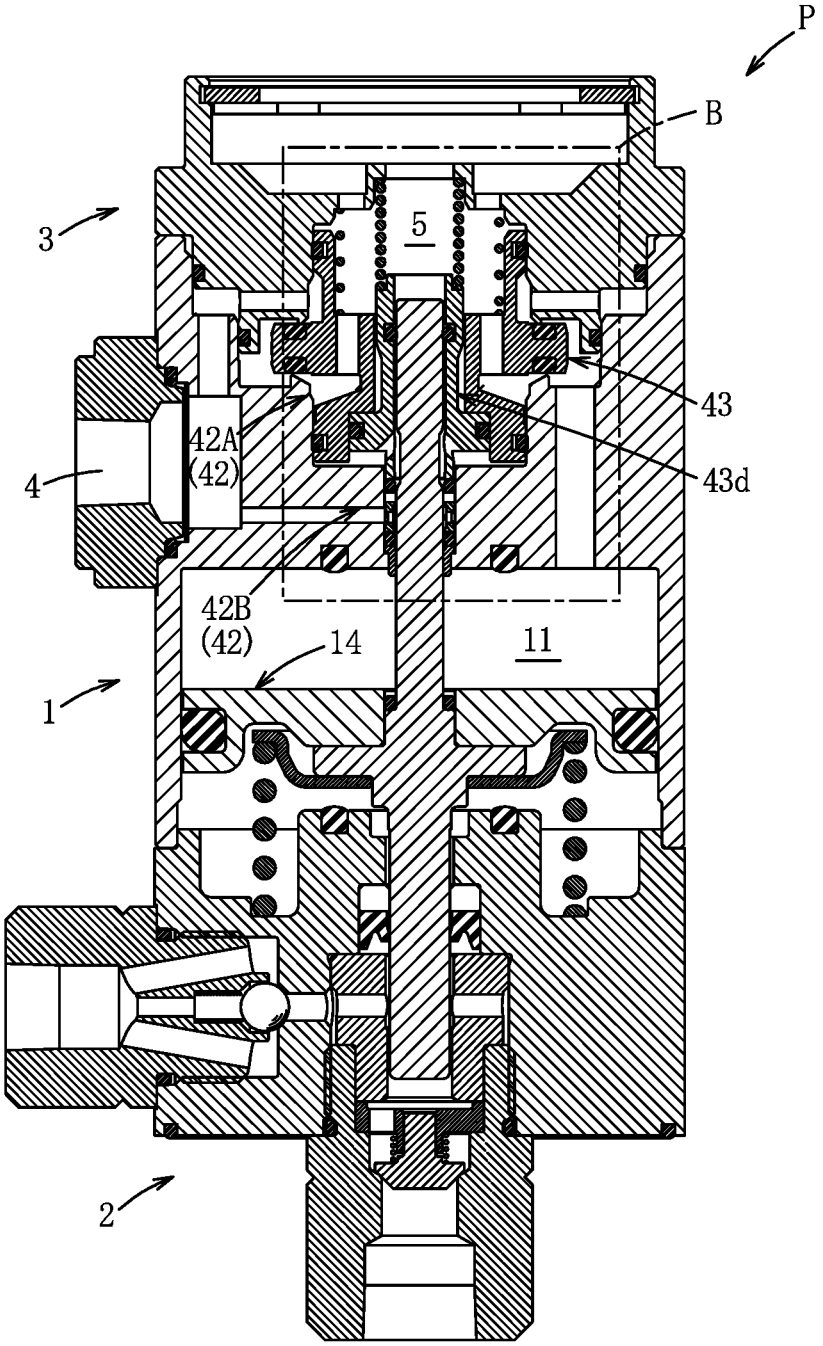
FIG. 5 is a vertical sectional view of the hydraulic pump (when its piston has started return motion)

As shown in FIGS. 2 through 4, the center side portion of the main valve body 43 close to the external circumference of the valve rod 35 is built as the auxiliary valve body 43*d*, which is separate from the other portion than the center side portion. The auxiliary valve body 43*d* comprises an auxiliary piston portion 60 and a tubular portion 61 that is integral with the auxiliary piston portion 60.

An air passage 62 that is capable of discharging compressed air in the air intake chamber 55 is defined between the inner circumferential surface of the tubular portion 61 and the outer circumferential surface of the valve rod 35. The auxiliary piston portion 60 is installed in an auxiliary piston reception hole 63 that is formed in the piston portion 46 so as to slide freely therein, and faces to the air intake chamber 55. The tubular portion 61 extends from the auxiliary piston portion 60 in the opposite direction from the air intake chamber 55, and passes through the cylindrical hole of the main valve body 43 so as to slide freely therein. The end portion of the tubular portion 61 of the auxiliary valve body 43*d* projects out toward the air discharge outlet 5, and a weak compression spring 64 is provided that biases the auxiliary valve body the air intake chamber 55. The lower half portion of the tubular portion 61 is formed to have a smaller diameter than that of 43*d* toward its upper half portion, and that it is built so as not to contact the inner circumferential surface of the cylindrical hole of the main valve body 43, so that the frictional force that operates on the auxiliary valve body 43*d* becomes small.

The first valve member 56 is made of an O ring, and this first valve member 56 is installed in an annular groove formed around the internal circumferential portion of the tubular portion 61. Moreover, the second valve member 57 is made of an O ring, and is installed in an annular clearance 65 between the valve rod 35 and the partition wall portion 31*a* so as to be movable in the length direction of the valve rod 35 (i.e. along its axial direction). A small diameter barrel portion 60*a* is provided to the auxiliary piston portion 60 of the auxiliary valve body 43*d*, extending downward from the auxiliary piston portion 60 and inserted into the upper end side portion of the annular clearance 65, and moreover receiving and stopping the second valve member 57 from the air intake chamber 55 side. Furthermore, a plurality of sloping air passages 66 are formed in the neighborhood of the upper portion of the small diameter barrel portion 60*a* and communicate the valve rod through hole of the auxiliary valve body 43*d* to the air intake chamber 55.

As shown in FIG. 4, a flanged sleeve 67 is fitted into and fixed in the lower end portion of the annular clearance 65. An O ring 68 and a spacer 69 are installed in the annular clearance 65 above the flanged sleeve 67, with this spacer 69 having a plurality of small holes 69*a* in a thinner intermediate stepped portion thereof; and the upper surface of the O ring 68 is pressed by the lower end surface of the spacer 69, while the second valve member 57 is received and stopped from below by the upper end surface of the spacer 69. The air passage 58 is formed so as to communicate with the plurality of small holes 69*a* in the intermediate stepped portion of the spacer 69.

With this hydraulic pump P, by compressed air being continuously supplied to the air supply opening 4, and by the piston 14 being repeatedly caused to perform reciprocating operation at high speed due to the operation of the main changeover valve 42A and the auxiliary valve 42B of the changeover valve mechanism section 3, it is possible for hydraulic fluid to be repeatedly expelled from the hydraulic pump mechanism section 2.

Figure 6:
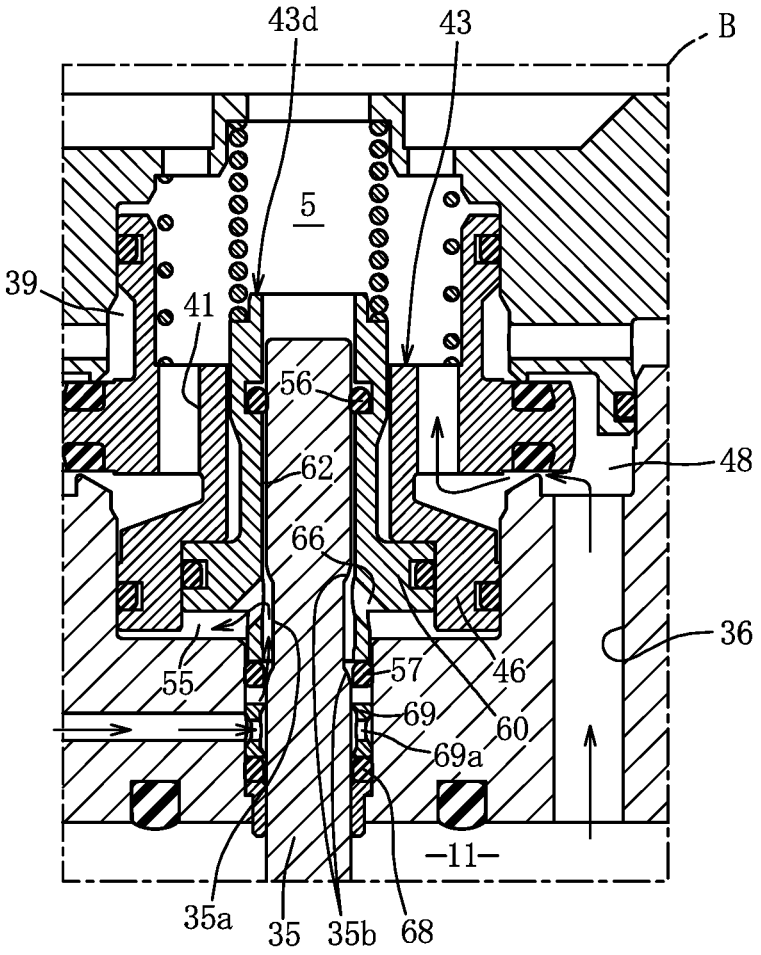
FIG. 6 is an enlarged view of a portion B of FIG. 5.

When the piston 14 reaches its forward motion limiting position as shown in FIG. 4, the auxiliary valve body 43*d* is relatively shifted upward with respect to the main valve body 43 by the gentle pressing force of compressed air that is intaken into the air intake chamber 55 from the small gap between the tapered portion 35*b* at the lower end of the small diameter portion 35*a* of the valve rod 35 and the second valve member 57, and the sealing of the second valve member 57 is reliably released due to the second valve member 57 being reliably shifted upward. At the next instant, as shown in FIG. 6, the compressed air intaken into the air intake chamber 55 operates on the piston portion 46 and the auxiliary piston portion 60, so that the main valve body 43 and the auxiliary valve body 43*d* are shifted upward by a small distance and the main changeover valve 42A is reliably changed over to its air discharge position.

By the auxiliary valve body 43*d* being built in this manner so as to be shiftable upward by a small compressed air force, when the piston 14 has reached its forward motion limiting position, the sealing of the second valve member 57 is broken via the tapered portion 35*b* at the lower end of the small diameter portion 35*a* of the valve rod 35, and, due to a small amount of compressed air that flows into the air intake chamber 55, the auxiliary valve body 43*d* is relatively shifted upward with respect to the main valve body 43, so that, by the second valve member 57 being shifted upward, the sealing of the second valve member 57 is reliably released via the small diameter portion 35*a*, and thus compressed air is rapidly introduced into the air intake chamber 55, whereby the main changeover valve 42A can be rapidly changed over to its air discharge position.

Even if the supply pressure of the compressed air fluctuates, the auxiliary valve body 43*d* does not experience any influence. Moreover, since the amount of hydraulic pressure consumed at the destination for supply of hydraulic fluid is minute, even if the piston 14 shifts at an extremely low speed, the auxiliary valve body 43*d* operates reliably as described above so that the main valve body 43 does not stop in a neutral position (i.e. in a state with all ports open). And it is also difficult for the main valve body 43 to stop in a neutral position, since the main valve body 43 is biased toward the air supply position by the compression spring 44.

Moreover, since in this construction the valve rod 35 does not strike against any other metallic member, accordingly no clattering noise is generated, even when the piston 14 repeatedly executes reciprocating operation at high speed.

The structure of the hydraulic pump P explained above is only shown by way of example; for a person skilled in the art, it would be possible to implement various partial alterations to the embodiment described above, while still not deviating from the spirit of the present invention.

The present invention provides a hydraulic pump which is a compressed air driven reciprocating piston hydraulic pump that generates hydraulic pressure continuously according to supply of compressed air thereto, and that can be utilized in applications of various kinds.

DESCRIPTION OF NUMERALS

P: compressed air driven reciprocating piston hydraulic pump
1: single acting type air cylinder
2: hydraulic pump mechanism section
3: changeover valve mechanism section
4: air supply opening
5: air discharge outlet
11: forward motion chamber
12: return motion chamber
13: cylinder member
13*a*: cylinder hole
14: piston
16: compression spring
21: plunger
31: valve case
31*a*: partition wall portion
32: upper end valve case
35: valve rod
35*a*: small diameter portion
35*b*: tapered portion (end portion of small diameter portion)
39: annular air passage
40: annular air exhaust passage
41: air passage
42: changeover valve mechanism
42A: main changeover valve
42B: auxiliary changeover valve
43: main valve body
43*d*: auxiliary valve body
43*a*: annular valve body portion
43*b*: piston portion defining portion
43*c*: barrel portion
44: compression spring
45: piston reception hole
46: piston portion
51, 52: first and second annular valve faces
53, 54: first and second annular valve seats
55: air intake chamber
56: first valve member
57: second valve member
58: air passage
60: auxiliary piston portion
60*a*: small diameter barrel portion
61: tubular portion
63: auxiliary piston reception hole
64: compression spring
65: annular clearance

The invention claimed is:

1. A compressed air driven reciprocating piston hydraulic pump comprising a drive piston installed in a cylinder hole of a cylinder member, the drive piston being configured to be reciprocatingly driven to and fro along an axial direction of the cylinder hole, a forward motion chamber and a return motion chamber at opposite sides of the drive piston in the cylinder hole, a compression spring for return motion provided in the return motion chamber, a hydraulic pump mechanism including a plunger extending from a center portion of the piston toward the return motion chamber, a valve case having a partition wall portion that serves as an end wall of said forward motion chamber, the valve case being fixed to an end portion of the cylinder member, an air supply opening for supply of compressed air and an air discharge outlet provided in the valve case, and a changeover valve mechanism including a main changeover valve that operates to change over repeatedly between an air supply position in which the forward motion chamber is communicated with the air supply opening and an air discharge position in which the forward motion chamber is communicated with the air discharge outlet and an auxiliary changeover valve that operates in synchrony together with the main changeover valve and changes over the position of the main changeover valve between the air supply position and the air discharge position, wherein:

the main changeover valve comprises a main valve body, and the main valve body comprises an annular valve body portion, and the annular valve body portion is biased toward the air supply position by compressed air in an annular air passage communicated to the air supply opening, and a piston portion defining portion is formed integrally with the annular valve body portion, and is shiftable along the axial direction;

the annular valve body portion has first and second annular valve faces that are formed at respective ends of the annular valve body portion along the axial shifting direction of the annular valve body portion and that alternatively contact against first and second annular valve seats of the valve case, and the piston portion defining portion that is received in a piston reception hole formed in the valve case; and the auxiliary changeover valve comprises an air intake chamber defined by the piston reception hole and the piston portion, a valve rod that passes through and slides freely in the partition wall portion of the valve case extending from the center portion of the piston towards the forward motion chamber, the air intake chamber, and the valve main body, a small diameter portion formed on the valve rod, a first valve member that is capable of sealing between the valve rod and the main valve body, and a second valve member that is capable of sealing between the valve rod and the partition wall portion;

and the auxiliary changeover valve is configured so that the auxiliary changeover valve, along with changing over the main changeover valve to its air supply position during a forward motion of the piston to enlarge the forward motion chamber, starts by releasing a seal of the first valve member between the valve rod and the main valve body by the small diameter portion and discharging compressed air from the air intake chamber, and the auxiliary changeover valve also changes over the main changeover valve to its air discharge position during a return motion of the piston to enlarge the return motion chamber, and starts by releasing a seal of the second valve member between the valve rod and the partition wall portion by the small diameter portion and intaking compressed air to the air intake chamber;

wherein:

a center side portion of the main valve body close to an external circumference of the valve rod is configured as an auxiliary valve body of the auxiliary changeover valve, the auxiliary valve body being separate from portions of the main valve body other than the center side portion;

the auxiliary valve body comprises an auxiliary piston portion that is installed into an auxiliary piston reception hole formed in the piston portion so as to slide freely therein in an airtight manner and that faces into the air intake chamber, and a tubular portion that extends from the auxiliary piston portion toward an opposite side to the air intake chamber and that is installed in a cylindrical hole of the main valve body so as to slide freely therein; and an end portion of the tubular portion of the auxiliary valve body faces into the air discharge outlet, and a compression spring is provided that biases the auxiliary valve body toward the air intake chamber, and the first valve member is installed in the tubular portion.

2. A compressed air driven reciprocating piston hydraulic pump according to claim 1, wherein a barrel portion is provided, formed integrally with the annular valve body portion and extending from an opposite side to the piston reception hole, and fitted into a cylinder hole of the valve case so as to slide freely therein, and in that the annular air passage is formed on an external circumference of the barrel portion.

3. A compressed air driven reciprocating piston hydraulic pump according to claim 1 wherein an annular air exhaust passage is defined by the annular valve body portion of the main valve body, the piston portion defining portion, and the valve case, and an air passage that communicates the annular air exhaust passage to the air discharge outlet is formed in the main valve body.

4. A compressed air driven reciprocating piston hydraulic pump according to claim 1 wherein an air passage for intaking compressed air from the air supply opening to the air intake chamber is formed in the valve case, and an air passage capable of discharging compressed air from the air intake chamber is defined between the tubular portion of the auxiliary valve body and an outer circumferential surface of the valve rod.

5. A compressed air driven reciprocating piston hydraulic pump according to claim 1 wherein the second valve member is installed in an annular clearance between the valve rod and the partition wall portion so as to be movable in a length direction of the valve rod, and a small diameter barrel portion that receives and stops the second valve member from the air intake chamber side is provided extending from the auxiliary piston portion of the auxiliary valve body and inserted into the annular clearance.

6. A compressed air driven reciprocating piston hydraulic pump according to claim 5, wherein the auxiliary changeover valve is constituted so that when the piston has reached a forward motion limiting position to limit the forward motion of the piston, the auxiliary valve body is relatively shifted with respect to the main valve body by compressed air intaken into the air intake chamber from between an end portion of the small diameter portion of the valve rod and the second valve member so as to release the sealing of the second valve member between the valve rod and the partition wall portion.

7. A compressed air driven reciprocating piston hydraulic pump according to claim 1 wherein a compression spring is provided that biases the main valve body of the main changeover valve to the air supply position.

* * * * *